US007909491B2

(12) United States Patent
Hoets et al.

(10) Patent No.: US 7,909,491 B2
(45) Date of Patent: Mar. 22, 2011

(54) CHAIN SUPPORT

(76) Inventors: Adam Anthony Hoets, Johannesburg (ZA); Sian Mary-Lyn Eliot, Johannesburg (ZA)

( * ) Notice: Subject to any disclaimer, the term of this patent is extended or adjusted under 35 U.S.C. 154(b) by 331 days.

(21) Appl. No.: 11/911,473

(22) PCT Filed: Apr. 7, 2006

(86) PCT No.: PCT/ZA2006/000052

§ 371 (c)(1),
(2), (4) Date: Jun. 4, 2008

(87) PCT Pub. No.: WO2006/110927

PCT Pub. Date: Oct. 19, 2006

(65) Prior Publication Data

US 2009/0213599 A1 Aug. 27, 2009

(30) Foreign Application Priority Data

Apr. 14, 2005 (ZA) ..... 2005/02991

(51) Int. Cl.
*F21V 17/02* (2006.01)

(52) U.S. Cl. ..... 362/449; 362/351; 362/382; 362/404; 362/431; 362/806

(58) Field of Classification Search ..... 362/351, 362/382, 404, 431, 449, 806
See application file for complete search history.

(56) References Cited

U.S. PATENT DOCUMENTS

| | | | | |
|---|---|---|---|---|
| 1,591,970 | A | 7/1926 | Gagnon | |
| 3,506,232 | A | 4/1970 | Wolar et al. | |
| 5,144,541 | A | 9/1992 | Schonbek | |
| 5,567,046 | A | 10/1996 | Lucas | |
| 7,225,851 | B2 * | 6/2007 | Schonbek et al. | 160/332 |

FOREIGN PATENT DOCUMENTS

| | | |
|---|---|---|
| DE | 202004012334 U1 | 9/2004 |
| GB | 706647 | 3/1954 |

* cited by examiner

*Primary Examiner* — Sandra L O Shea
*Assistant Examiner* — Meghan K Dunwiddie
(74) *Attorney, Agent, or Firm* — Seed IP Law Group PLLC

(57) ABSTRACT

A chain support (10) is provided which includes a substantially planar body (12) which defines a plurality of seats (14) spaced apart in a predetermined configuration, and a plurality of passages (20) from the seats (14) to the edges (18) of the body (12). A plurality of chains (22) may be suspended from the body (12), one from each seat (14), so as to create a curtain (36) of chains (22). The support (10) with chains (22) suspended therefrom may be used as a lampshade (42), curtain, or the like.

19 Claims, 5 Drawing Sheets

CHAIN SUPPORT

FIELD OF THE INVENTION

This invention relates to a chain support. In particular, but not exclusively, the invention relates to a support for a plurality of ball-chains.

BACKGROUND TO THE INVENTION

Ball-chains are known and comprise spherical balls, often manufactured from a metallic material, and elongate links, intermittently connected to one another to form a chain. The link sections may themselves be manufactured from any suitable material such as organic fibers, polymers or metals. The links also often have a degree of flexibility so as to give the chain as a whole a desired degree of flexibility. Alternatively, the links may be rigid and the points of connection between the balls and the links may allow for pivotal movement of the links relative to the balls in order to give the chain the desired degree of flexibility. It is also known to manufacture ball-chains by securing spherical balls spaced apart along the length of a piece of string.

Ball-chains are most commonly used to suspend objects like bath tub and basin plugs from connection points on the surfaces of the tubs and basins, or for connecting articles of adornment to key rings or the like. They are also used for decorative purposes and in the manufacture of jewelry.

In addition to ball-chains, a number of ball-chain connectors are also known. These connectors come in a variety of shapes and are used for various purposes. Connectors are, for example, used to join separate ball-chains end-on-end to make endless assemblies for key chains, neck chains and the like, they may act as connecting links to splice lengths of chain, and they may be used to provide flexible, swiveling, permanent attachments for hanging objects. Connectors may also be supplied with jump rings to attach parts such as sink stoppers and the like to ball-chains.

Connectors may also be used to attach ball-chains to surfaces with, for example, screws, bolts or rivets. Certain connectors may also be used to retain ball-chains to pens, electrical outlet caps and the like, or for attaching ball-chains to light actuators to serve as pulls for electric lighting socket extension chains, convector controls or the like.

OBJECT OF THE INVENTION

It is an object of this invention to provide a practical and efficient support for a plurality of chains and, more particularly, for a plurality of ball-chains.

SUMMARY OF THE INVENTION

In accordance with this invention there is provided a chain support comprising:

- a body defining a plurality of seats spaced apart in a predetermined configuration from which chains can be suspended; and
- at least one passage from an edge of the body to the seats.

Further features of the invention provide for the passage to extend to each of the seats; for there to be a plurality of passages from the edge of the body, and for each passage to provide access to at least one seat.

Still further features of the invention provide for the body to be substantially planar.

Yet further features of the invention provide for the seats to be spaced apart adjacent one another near the periphery of the body and for the body to define a passage from each of the seats to an edge of the body; and for a number of chains to be suspendable from the seats so as to form a curtain of chains suspended from the body.

Further features of the invention provide for the seats to be apertures through the body or, alternatively, indentations in the body; and for the chain to be a ball-chain.

Still further features of the invention provide for the body to be laser-cut, stamped, die-cut or water-jet-cut; and for the chain support to be an ornament or a lampshade.

The invention further provides a lampshade comprising:

- a substantially planar body defining a plurality of seats spaced apart in a predetermined configuration over the surface of the body;
- at least one passage from an edge of the body to the seats; and a plurality of chains, each of which is suspended from a seat.

Further features of the invention provide for the body to define a passage from each of the seats to an edge of the body; for the seats to be apertures through the body or, alternatively, indentations in the body; for the chain to be a ball-chain; and for the body to be laser-cut, stamped, die-cut or water-jet-cut.

BRIEF DESCRIPTION OF THE DRAWINGS

The invention will now be described, by way of example only, with reference to the accompanying drawings in which.

DETAILED DESCRIPTION OF THE DRAWINGS

Figure 1:
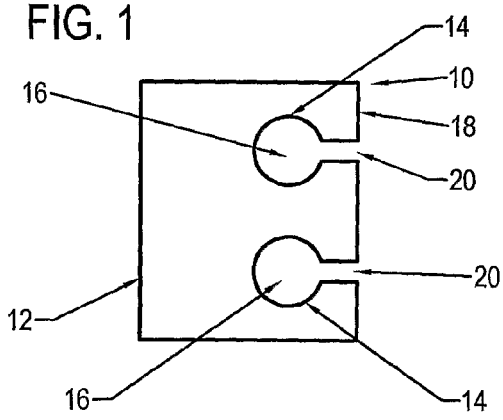
FIG. 1: is a top view of a chain support in accordance with a first embodiment of the invention.

A chain support (10) is shown in FIG. 1 and is provided by a generally planar body (12) defining a plurality, in this instance two, seats (14) in the form of apertures (16) near its edge (18). The body (12) further defines two passages (20) from the edge (18), one to each of the seats (14).

Figure 2:
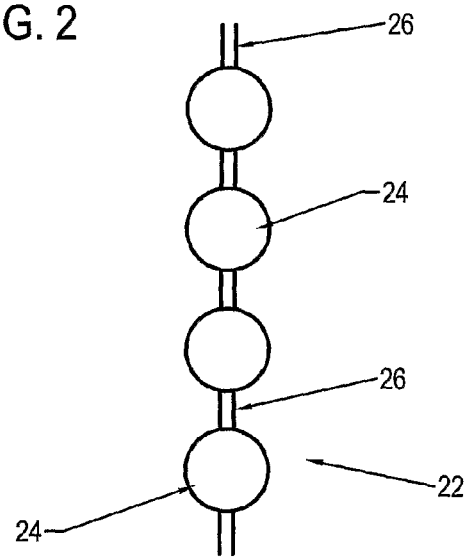
FIG. 2: is a side view of a ball-chain suitable for use with the support shown in FIG. 1.

A ball-chain (22), as shown in FIG. 2, has a number of spherical balls (24) connected to one another with elongate links (26). The balls (24) are manufactured from a metallic material and the links (26) are manufactured from a flexible string.

Figure 3:
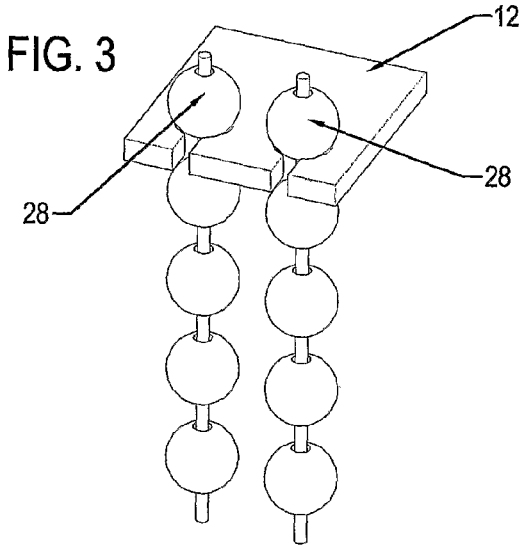
FIG. 3: is a perspective view of a ball-chain as shown in FIG. 2, suspended from the support as shown in FIG. 1.

In order to suspend the ball-chain (22) from the support (10), a link section (26) of a ball-chain (22) is passed through the passage (20) such that at least one of the balls (28) passes over the top of the body (12) and the remainder of the ball-chain (22) hangs below the body (12). Once the ball (28) is positioned directly above an aperture (16) it is lowered and comes to rest in the seat (14) formed by the aperture (16). In the same way, a second ball-chain (22) may be suspended from the second seat (14) thereby suspending two ball-chains (22) from the chain support (10) in a side-by-side configuration as shown in FIG. 3.

Figure 4:
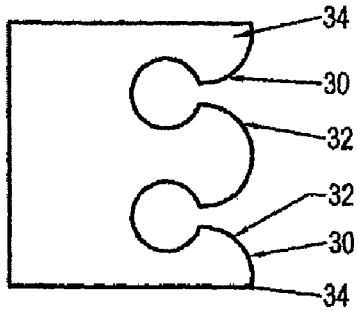
FIG. 4: is a top view of an alternative embodiment of a chain support.

An alternative embodiment of the chain support (10) is shown in FIG. 4. In this embodiment, the outer edges (30) of the passages (20) are rounded to create sliding surfaces (32) tapering towards the seats (14). It will be appreciated that the rounded edges (30) and the sliding surfaces (32) aid the insertion of the ball-chains (22) through the passages (20). It will also be appreciated that the distance between the innermost edges (34) of the sliding surfaces (32) may be marginally smaller than the diameter of the links (26) on the ball-chains (22). If this is the case, the links (26) will temporarily have to partially deform to move past the edges (34). Once past the edges (34), the edges (34) act as detents, preventing the links from passing back through the passages (20).

Figure 5:
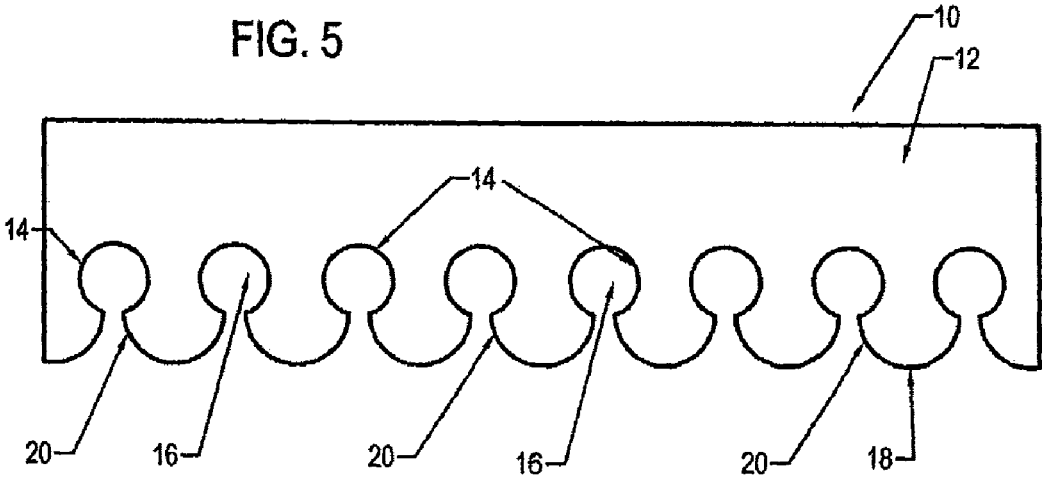
FIG. 5: is a perspective view of an adaptation of the chain support of FIG. 4.
Figure 6:
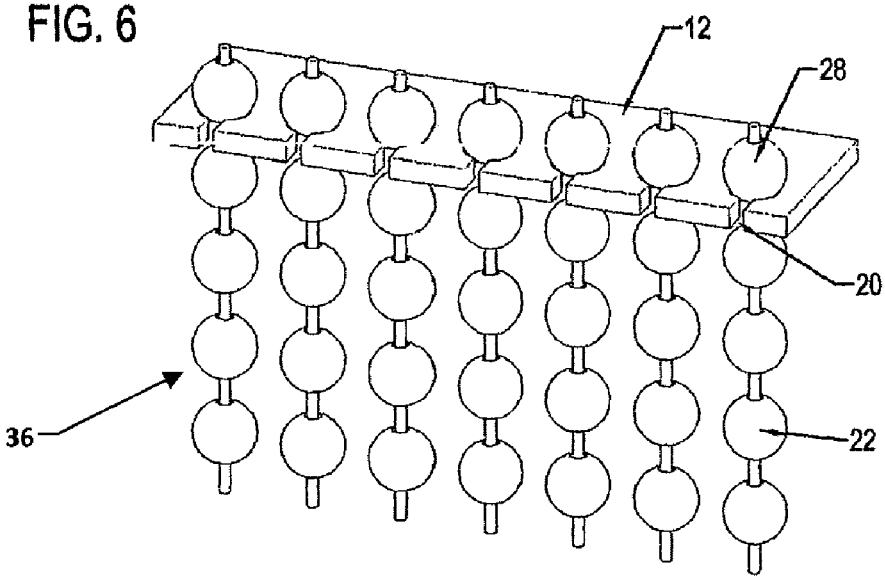
FIG. 6: is a perspective view of a chain support in accordance with FIG. 5 having an array of ball-chains suspended therefrom.

In FIG. 5, an alternative embodiment of the chain support (10) of FIG. 4 is shown. In this embodiment, the body (12) is cut into a predetermined shape and defines a number of seats (14) in the form of apertures (16) in a side-by-side configuration near an edge (18) of the body (12). The edge (12) in this embodiment is considerably longer than that of the body (12) in FIG. 4. The body also defines a number of passages (20), equal in number to the number of apertures (16) in the body. Each passage (20) extends from the edge (18) to a seat (14). The body (12) is laser-cut from a metallic material and can be cut into any required shape. In this embodiment, an array of ball-chains (22), as shown in FIG. 3, can be suspended from the body (12) in a side-by-side configuration, as shown in FIG. 6, thereby creating a curtain (36) of ball-chains (22).

Figure 7:
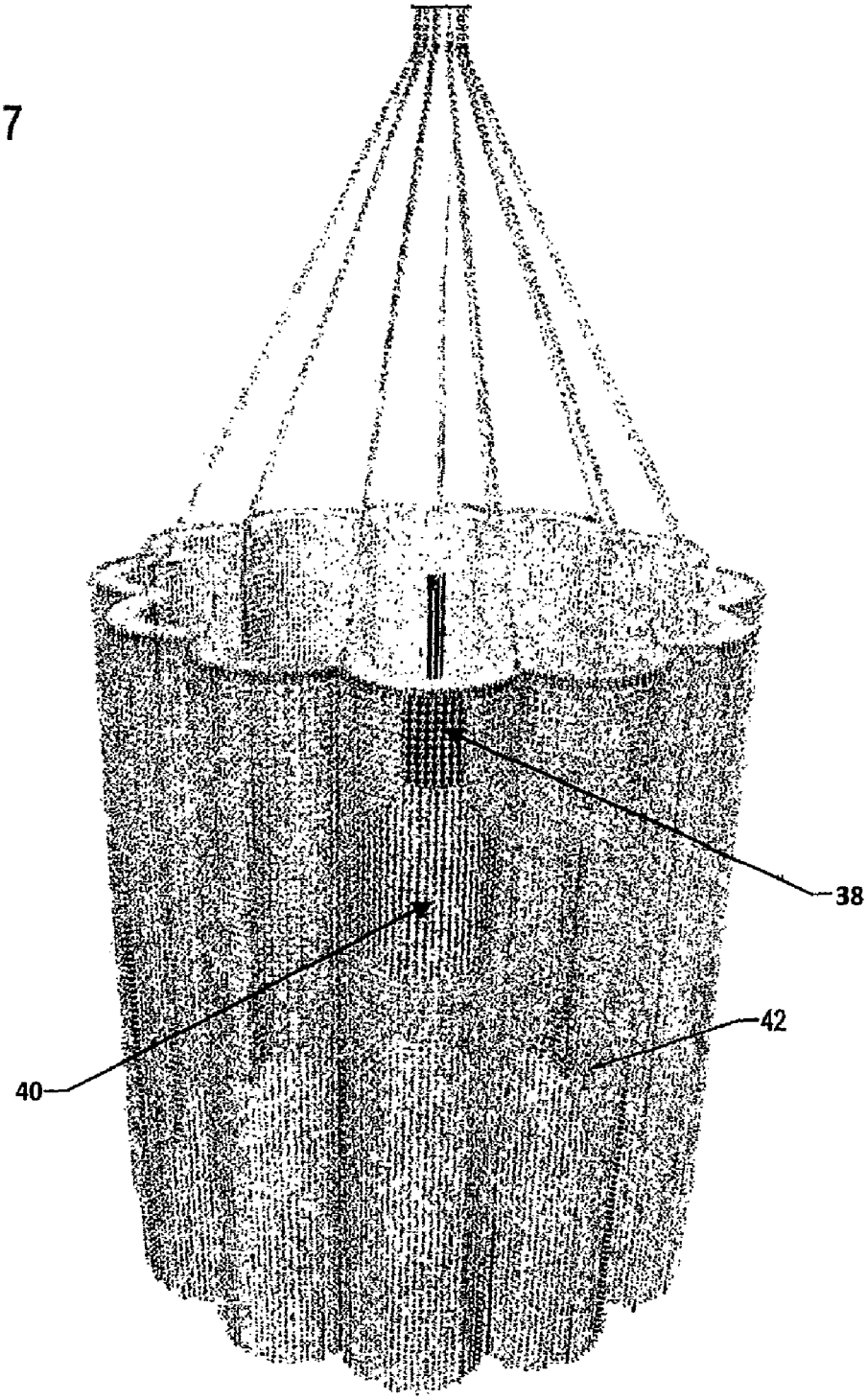
FIG. 7: is a perspective view of a lamp shade utilizing the chain support in accordance with the invention.

In a preferred embodiment of this invention, as shown in FIG. 7, the body (12) of the support (10) is laser-cut into a predetermined shape, and defines seats and passages, as explained with reference to FIGS. 1 to 7, along the entire periphery of the body (12). As explained with reference to FIG. 6, an array of ball-chains (22) can be suspended from the body (12) and will form a closed curtain (36) of ball-chains (22). It will be appreciated that the shape of the body (12) is by no means limited. In this embodiment, the support (10) may also be retrofitted with a light-bulb socket (38). The socket (38) may be fitted below the plane of the body (12) within the boundaries of the curtain (36). If the socket (38) is connected to an electricity supply and a light bulb (40) connected to the socket (38), the ball-chain curtain (36) serves as a lampshade (42). It will be appreciated that the spherical surfaces of the balls (24) on the ball-chains (22) refract the light emitting from the bulb (42) in an aesthetically pleasing way.

From the above description it should be evident to a person skilled in the art that the shape of the body is by no means limited. The invention therefore lends itself to the creation of customized lamp shades or chandeliers using curtains of ball-chains suspended from the body. It should also be evident that the seat and passage configuration on the periphery of the body makes it possible for the ball-chains to be easily attached, altered or removed if necessary.

Figure 8:
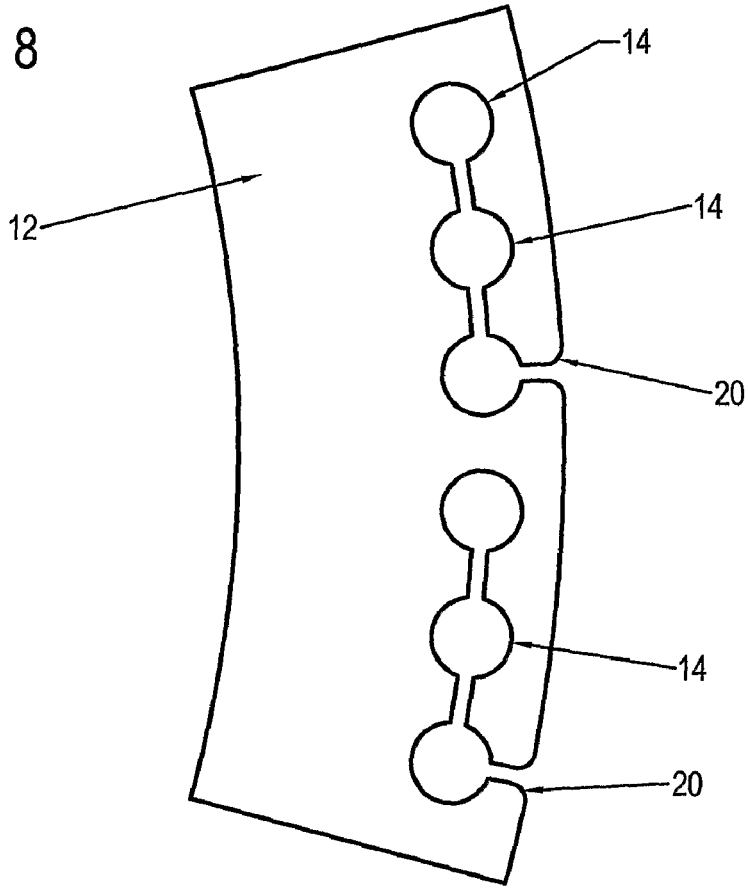
FIG. 8: is a top plan view of an alternative embodiment of a chain support in accordance with the invention.

As shown in FIG. 8, it is also possible that the body (12) may define a plurality of seats (14), but may have a smaller number of passages (20) than the number of seats (14). In this configuration, each passage (20) may provide access to a number of seats (14).

Figure 9:
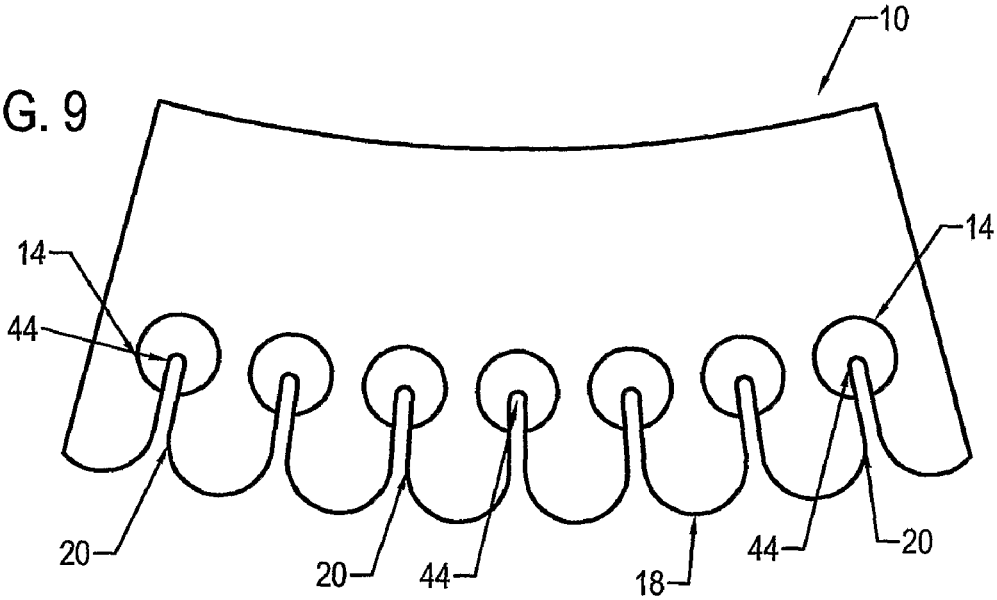
FIG. 9: is a top plan view of a further alternative embodiment of a chain support.

FIG. 9 shows a chain support (10) in accordance with the invention having a body (12) defining alternatively shaped seats (14) in the form of indentations (44) near its edge (18) and passages (20) from the edge (18) to the seats (14), as before. It will be appreciated that the aperture as explained with reference to FIGS. 1 to 8 and the indents as explained with reference to FIG. 9, are not the only ways of defining the seats in the body. What is of importance for the purposes of the invention is the fact that a seat must be provided which offers a measure of resistance to lateral movement of the ball seated therein. It is furthermore an important aspect of the invention that a passage is provided whereby ball-chains may be inserted from an edge of the body.

Figure 10:
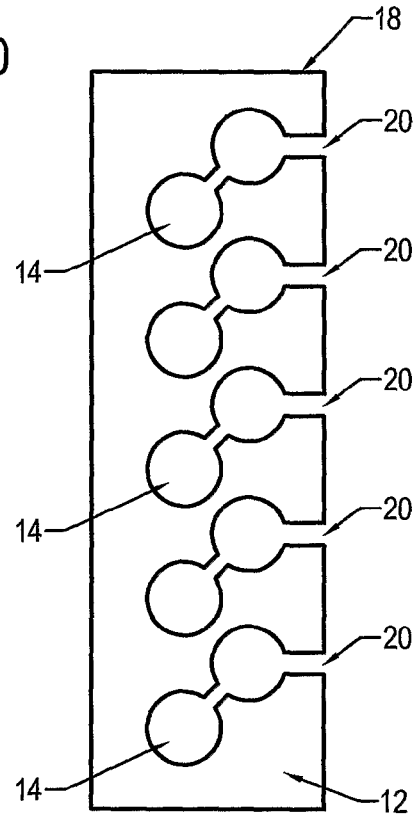
FIG. 10: is a top plan view of a further alternative embodiment of a chain support.

It is envisaged that the body may also define the seats in alternative configurations. An example of such an alternative configuration is shown in FIG. 10 where the seats (14) are essentially arranged in two rows. Each passage (20) from the edge (18) provides access to a seat (14) positioned in each of the rows. The important aspect for the purpose of the invention is that a passage is provided to each of the seats so that ball-chains may be suspended therefrom.

It will also be appreciated that the body may be manufactured form any suitable material such as metal, wood, glass, board, fabrics or plastics, and also that the method of manufacturing of the body may vary depending on the material used. It is, for example, envisaged that the body may be manufactured using a variety of processes such as laser-cutting, die-cutting, stamping, water-jet-cutting, carving or any other suitable process.

It will furthermore be appreciated that the chain support may be used in a variety of applications of which lamp shades and chandeliers are but two. It is, for example, envisaged that the chain support may be used for creating light fittings, architectural fittings, screens, dividers and curtains as well as fashion accessories, jewelry and clothing, but are not limited in its application to these.

Figure 11:
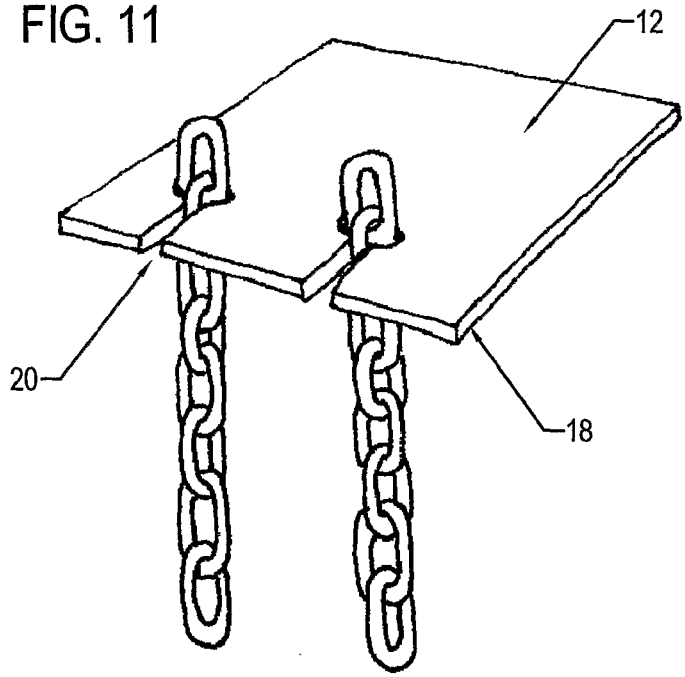
FIG. 11: is a perspective view of a chain support in accordance with the invention from which an alternative type of chain is suspended.

Finally, it should also be appreciated that the chain support may also be used with conventional link chains instead of ball-chains. FIG. 11 shows the support of FIG. 3 used for suspending link chains.

Although the present invention is described above in connection with a number of preferred embodiments and variations of the embodiments, those of ordinary skill in the art will understand that many modifications can be made to the invention described without departing from the scope of the claims that follow. For example, the shape of the body, number of seats and number of passages are not limited in any way. Accordingly, it is not intended that the scope of the invention is in any way limited by the above description, but should instead be determined entirely by reference to the claims that follow.

The invention claimed is:

1. A chain support, comprising:

a substantially planar body defining a plurality of seats spaced apart in a predetermined configuration from which one or more chains can be suspended; and at least one passage from an edge of the body to the seats; each passage defining a gap portion having a first dimension corresponding to a width thereof and which is smaller than a second dimension corresponding to a diameter of a link section associated with a connection region of the chain, the first and second dimensions facilitating a snap fit insertion of the chain through the gap portion and the detention of the chain in the seat once it has been so inserted.

2. The chain support of claim 1 wherein the chains are ball chains, each of said ball chains having a series of spaced apart balls intermittently connected with elongate link sections.

3. The chain support of claim 2 having a plurality of passages from the edge of the body, each of said passages providing access to at least one seat.

4. The chain support of claim 2 having a single passage which extends to each of the seats.

5. The chain support of claim 1 in which a chain can be suspended from each of the seats so as to form a curtain of chains suspended from the body.

6. The chain support of claim 1 in which each seat is provided by an aperture in the body.

7. The chain support of claim 1 in which each seat is provided by an indentation in the body.

8. The chain support of claim 1 in which the body is manufactured by a process selected from the group consisting of laser-cutting, stamping, die-cutting and water jet cutting.

9. The chain support of claim 8 in which the body is laser-cut from a resiliently deformable sheet metal.

10. The chain support of claim 1 which is an ornament.

11. The chain support of claim 1 which is a lampshade.

12. A lampshade, comprising:

a substantially planar body defining a plurality of seats spaced apart in a predetermined configuration over the surface of the body;

at least one passage from an edge of the body to the seats; and a plurality of chains each of which is suspended from a seat, wherein each passage defines a gap portion having a first dimension corresponding to a width thereof and which is smaller than a second dimension corresponding to a diameter of a link section associated with a connection region of the chain, the first and second dimensions facilitating a snap fit of the chain through the gap portion and the detention of the chain in the seat once it has been so inserted.

13. The lampshade of claim 12 having a passage from each of the seats to an edge of the body.

14. The lampshade of claim 13 in which each seat is provided by an aperture through the body.

15. The lampshade of claim 13 in which each seat is provided by an indentation in the body.

16. The lampshade of claim 12 in which each chain is a ball chain having a series of balls intermittently connected with elongate link sections.

17. The lampshade of claim 12 in which the body is laser-cut.

18. The lampshade of claim 17 in which the body is laser-cut from a resiliently deformable sheet metal.

19. A chain support, comprising:

a substantially planar body defining a plurality of seats spaced apart in a predetermined configuration from which one or more chains can be suspended; and at least one passage from an edge of the body to the seats; each passage defining a gap portion having a first dimension corresponding to a height thereof which in turn corresponds to a thickness of the body, and which is larger than a second dimension corresponding to a length of a link section associated with a connection region of the chain, the first and second dimensions facilitating a snap fit of the chain through the gap portion and the detention of the chain in the seat once it has been so inserted.

* * * * *